United States Patent [19]

Prazak, III

[11] Patent Number: 4,884,006

[45] Date of Patent: Nov. 28, 1989

[54] INNER SURFACE SPECULAR REFLECTION SUPPRESSION IN FLAT CRT FACEPLATE

[75] Inventor: Charles J. Prazak, III, Elmhurst, Ill.

[73] Assignee: Zenith Electronics Corporation, Glenview, Ill.

[21] Appl. No.: 947,732

[22] Filed: Dec. 30, 1986

[51] Int. Cl.[4] ..... H01J 29/28; H01J 9/20

[52] U.S. Cl. ..... 313/474; 313/477 R; 313/478; 313/479; 313/116; 358/252

[58] Field of Search ..... 313/474, 477 R, 478, 313/479, 116; 358/247, 252, 250; 445/8

[56] References Cited

U.S. PATENT DOCUMENTS

| | | | |
|---|---|---|---|
| 2,612,611 | 9/1952 | Szegho et al. | 313/478 X |
| 2,680,205 | 6/1954 | Burton | 313/478 |
| 2,734,142 | 2/1956 | Barnes | 358/252 X |
| 2,977,412 | 3/1961 | Rhodes et al. | 313/474 X |
| 3,209,191 | 9/1965 | Hamilton | 313/110 |
| 3,813,568 | 5/1974 | Scott et al. | 313/463 |
| 4,310,783 | 1/1982 | Temple et al. | 313/474 |
| 4,310,784 | 1/1982 | Anthon et al. | 313/474 |
| 4,565,946 | 1/1986 | Barrett et al. | 313/474 X |
| 4,656,388 | 4/1987 | Strauss | 313/402 |
| 4,731,558 | 3/1988 | Haisma et al. | 313/474 |

OTHER PUBLICATIONS

Coes, Loring, "Loose Abrasive Operations", Abrasives, New York, New York, Springer-Verlag, 1971.

Keefe, James V., "Free-Abrasive Machining: A New Concept in Flat Grinding", Proceedings of the Fifteenth Annual Engineering Society Conference, Plymouth, Michigan: Abrasives Engineering Society, 1977.

Lane, R. L., "ID Slicing Technology for Large Diameters", Solid State Technology, vol. 28, No. 7, Jul. 1985.

Reed, Walter J., "Flat Surface Problems? Try Free-Abrasive Machining", Machine and Tool Bluebook, vol. 74, No. 12, Dec., 1979.

Troka, Albin G., "Production Bottlenecks"—Let's Take a Look at Free Abrasive Machining, Machine and Tool Bluebook, vol. 65, No. 1, Jan., 1970.

Zorn, Fred J., "Free-Abrasive Machining", 1983, Proceedings: Twenty First Abrasive Engineering Society Conference, Pittsburgh, PA, Abrasives Engineering Society, Apr., 1983.

*Primary Examiner*—Donald J. Yusko

*Assistant Examiner*—Michael Horabik

[57] ABSTRACT

Inner specular reflection is suppressed in a flat faceplate for use in a color cathode ray tube (CRT) by forming a flat glass faceplate to have an aft, or inner surface characterized by an undefined roughness. By allowing for an aft surface of undefined roughness, a subsequent lapping process is utilized to produce a predetermined roughness of the aft surface that will substantially eliminate specular reflection from that surface.

8 Claims, 2 Drawing Sheets

INNER SURFACE SPECULAR REFLECTION SUPPRESSION IN FLAT CRT FACEPLATE

CROSS-REFERENCE TO RELATED APPLICATION

This application is related to but in no way dependent upon U.S. Pat. Nos. 4,739,412, issued Apr. 19, 1988 and 4,737,681, issued Apr. 12, 1988, both of which are assigned to the assignee of the present application.

BACKGROUND OF THE INVENTION

This invention relates generally to cathode ray tube (CRT) faceplates and is particularly directed to reducing inner surface reflection toward a viewer in a flat faceplate such as used in a color CRT with a flat tensioned shadow mask.

A conventional CRT consists of an evacuated envelope having a neck portion, a faceplate, and a funnel portion therebetween. An electron gun disposed in the neck portion of the envelope emits energetic electrons which are directed onto the inner surface of the faceplate. Disposed on the inner surface of the faceplate are a large number of phosphor elements which glow momentarily when struck from the rear by electrons from the electron gun to produce a video image which is visible through the faceplate.

A CRT is particularly susceptible to the effects of ambient light incident upon its faceplate. Ambient light produces reflections from both the outer, or forward, surface of the CRT's faceplate as well as from its inner, or aft, surface. In the past, the curved surfaces of the CRT's faceplate have typically been roughened to a given surface texture either by pressing the glass surface, called stippling; by using a chemical process such as acid etching; or have been covered with a layer of an anti-reflection coating to reduce reflections directed back toward the viewer which degrade the video image. The pressing and acid etching approaches roughen the surfaces of the faceplate so as to reduce specular reflection from the faceplate and increase its diffuse reflection. The layers of anti-reflection coating deposited on the faceplate's surfaces possess interference properties selected so as to minimize ambient light reflected from its forward and aft surfaces toward the viewer.

One example of the use of surface coatings on a CRT's faceplate for reducing reflections can be found in U.S. Pat. No. 4,310,784 to Anthon et al, wherein it is disclosed the use of an anti-reflection coating disposed on the outer surface of the faceplate to reduce reflection and suppress the central portion of he halo surrounding an illuminated spot on the faceplate. An angle sensitive thin film interference coating which exhibits high transmittance for light emitted by the phosphor at low angles of incidence and high reflectance for light emitted by the phosphor at high angles of incidence is disposed on the inner surface of the faceplate to suppress the outer ring-like portion of the halo arising from internal reflection of light generated by the phosphor screen. U.S. Pat. No. 4,310,783 to Temple et al discloses the use of an absorbing filter disposed between the phosphor screen and faceplate of a CRT for absorbing light emitted from the phosphor screen in combination with an angle sensitive shortwave pass filter disposed between the phosphor screen and the absorbing filter for reflecting light emitted at a high angle from the phosphor screen to reduce reflections from the faceplate and for suppressing the halo effect of the illuminated phosphor dots. U.S. Pat. No. 3,209,191 to Hamilton discloses a CRT screen and ambient light filter disposed between the phosphor layer and the inner surface of the glass faceplate which is comprised of a transparent material in which are embedded a plurality of filter elements having a grid pattern which causes ambient light rays striking the surface of the filter body at acute angles other than normal to be refracted into cells formed within the grid pattern such that the light rays strike one or another of a plurality of depthwise spaced lines of opaque or light absorbing material and are absorbed thereby. The aforementioned approaches reduce light incident at angles off of normal, but not light generally normal to the surfaces of the faceplate such as would be present in a bright room and which would appear as a reflection of the room itself or of a viewer positioned in front of the CRT.

Recent work in the area of video displays has led to the development of color CRT's which employ a flat faceplate in combination with a flat tensioned shadow mask which provide improved brightness and/or contrast of the video image. Although offering enhanced video imagery, CRTs with a perfectly flat faceplate are still subject to ambient light reflection. Attempts to reduce reflection in this type of CRT have paralleled efforts in this area with respect to curved faceplate CRTs and have generally involved a roughening of the faceplate's surfaces using mechanical, e.g., sandblasting, lapping, etc., or chemical, e.g., etching, techniques. More specifically, some approaches to reducing faceplate internal reflection have involved a stepwise procedure consisting of pressing the surfaces of the faceplate during fabrication to provide a generally planar surface, grinding or lapping the faceplate until its surfaces are perfectly flat, then polishing to a mirror finish and subjecting the faceplate to an acid etching process providing the thus polished surfaces with a given texture. The polishing operation is necessary to remove the scratches and other irregularities incorporated in the glass surface during the first lapping operation. This multi-step approach provides a flat faceplate which exhibits relatively low reflectance and offers a high degree of video image acuity, but requires considerable processing time and increases the cost of flat faceplates thus produced. In addition, acid etching leads to an increase in the size of minute scratches in the glass surface resulting in reduced video image acuity and, where severe, rejection of defective faceplates.

It would be desirable from cost and process time considerations to be able to generate the low specular reflection surface mechanically, i.e., by lapping, but most conventional lapping processes use a soft cast iron lapping wheel which as indicated above is prone to scratching, making the resultant surface unusable. In addition, the grit imbeds itself into the cast iron surface, creating a very aggressive grind, which causes the final surface to be too rough. The basis for the present invention includes the discovery that lapping by rubbing a hand sized piece of glass over the piece being lapped, with a water suspension of grit between the surfaces, a very gentle lap could be produced with a roughness capable of eliminating specular reflections, but still smooth enough to allow acceptable application of the black matrix screen.

Apparently the glass surfaces are hard enough to prevent the grit from imbedding, allowing the grit to roll rather than scrape over the rubbing surfaces.

It was also found that use of this type of lapping was sufficient to eliminate the intermediate polishing step, since the scratches produced by conventional lapping were eliminated by this free abrasive process.

OBJECTS OF THE INVENTION

Accordingly, it is an object of the present invention to improve the presentation of a video image in a CRT having a flat faceplate.

It is another object of the present invention to reduce the internal specular reflection in a flat faceplate used in a CRT.

It is yet another object of the present invention to simplify the manufacture and reduce the cost of glass faceplates as used in CRTs of the flat tension shadow mask type.

A further object of the present invention is to provide a flat CRT faceplate with external and internal anti-glare surfaces.

A still further object of the present invention is to provide an anti-glare arrangement for the glass faceplate of a CRT which is integral with the faceplate and does not degrade the video image transmitted through the faceplate.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
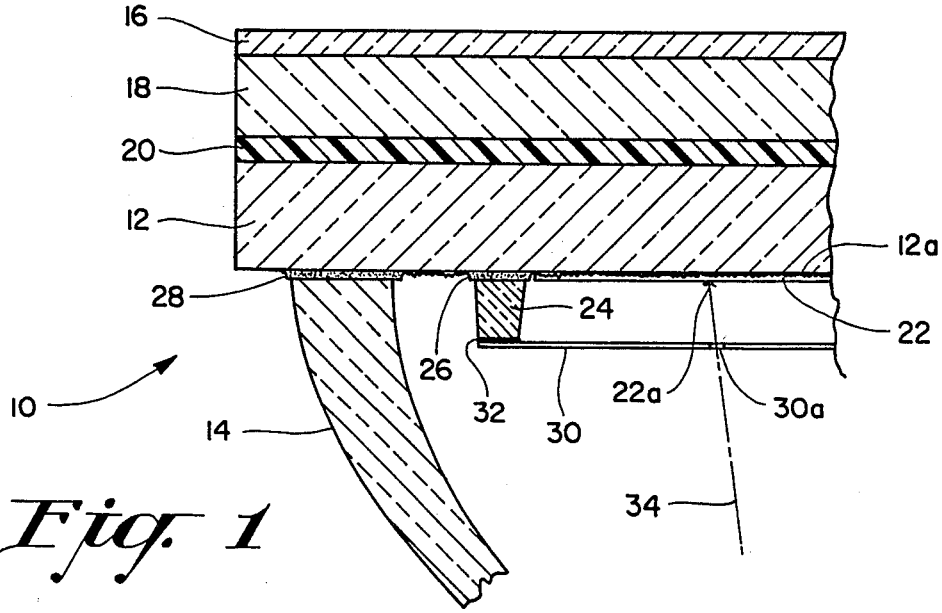
FIG. 1 is a partial sectional view of a flat CRT faceplate having internal specular reflection suppression in accordance with the principles of the present invention.

Referring to FIG. 1, there is shown a partial sectional view of a CRT 10 in which a flat glass faceplate 12 with reduced internal specular reflection in accordance with the present invention is intended for use. The CRT 10 includes the flat glass faceplate 12, a glass funnel 14, and a glass neck portion which is not shown in the figure for simplicity. The funnel 14 is securely attached to an aft, or inner, surface of the flat faceplate 12 by conventional means such as a sealing glass frit 28 disposed therebetween. The entire leading edge portion of the funnel 14 is coupled in sealed contact with the flat faceplate 12 permitting the volume defined by the funnel, the faceplate and the neck portion of the CRT to be placed under vacuum and thus form an evacuated envelope.

A glass implosion panel 18 is bonded to a forward, or exterior, surface of the flat faceplate 12 by means of a resin layer 20. The implosion panel 18 is substantially thinner and more flexible than the flat faceplate 12 and, in a preferred embodiment, is comprised of a commercial double strength window glass with a thickness of $\frac{1}{8}$ inch. The implosion panel 18 is coated on its outer surface with a thin layer of an anti-reflection material 16. In one embodiment, the resin layer 20 is comprised of two layers of resin having different compositions with different adhesive properties for improved implosion protection for the CRT 10. The resin layer 20 preferably possesses an index of refraction that substantially matches the index of refraction of the flat faceplate 12 as well as that of the implosion panel 18. As described in the aforementioned application, where two resin layers are used, the inner resin layer forms a strong bond with the outer resin layer and a relatively weak bond with the flat faceplate 12. The bond thus formed with the flat faceplate 12 is sufficient to retain the implosion panel 18 on the glass faceplate through normal use, packaging and handling of the CRT, but is not sufficient to maintain adhesion to the glass faceplate if the latter is deflected inwardly due to an impact. In this manner, implosion protection is provided by inhibiting outward deflection of the flat faceplate 12, and glass pieces thereof, while inward displacement of a broken faceplate is facilitated providing implosion protection for a viewer.

Mounted to the aft, or inner, surface 12*a* of the flat faceplate 12 is a shadow mask support structure 24. Mounted to an aft edge of the shadow mask support structure 24 is a metal foil shadow mask 30 maintained under tension. In one CRT embodiment, the faceplate 12, the shadow mask support structure 24, and the metal foil tensioned shadow mask 30 are generally rectangular. In this embodiment, the shadow mask support structure 24 is comprised of four elongated, linear rails coupled so as to form a closed rectangular structure on the aft surface of the flat faceplate 12. The shadow mask support structure 24 may be comprised of either a metallic or ceramic material and is securely maintained on the aft surface of the flat faceplate 12 by means of a sealing glass frit 26 disposed therebetween. The foil tensioned shadow mask 30 is preferably comprised of a high strength, thin metal sheet having a plurality of minute apertures 30*a* therein through which one of three electron beams 34 is directed. Where the shadow mask support structure 24 is comprised of metal, a plurality of weldments 32 may be disposed on the aft edge of the support structure to securely affix the foil tensioned shadow mask 30 thereto and maintain it in a stretched, taut configuration. Where the shadow mask support structure 24 is comprised of a ceramic material, a sealing glass frit such as used to affix the support structure to the flat faceplate 12 may be used to securely mount the foil tensioned shadow mask 30 to an aft edge portion of the support structure.

As described above, one of three electron beams 34 is directed through each of the apertures 30*a* in the foil tensioned shadow mask 30. Disposed on the rear surface 12*a* of the flat faceplate 12 is a phosphor screen 22 comprised of a plurality of phosphor elements 22*a* which are typically in the form of individual dots. As shown in the figure, the aft surface 12*a* of the flat faceplate 12 is provided with a somewhat roughened texture in accordance with the present invention to reduce internal reflections of the flat faceplate. Internal reflections occur when light transmitted through the implosion panel 18 is incident upon and reflected by the rear surface of the flat faceplate and re-emerges from the flat faceplate in the direction of a viewer located above the CRT 10 with reference to FIG. 1. By providing the flat faceplate 12 with a roughened aft surface 12*a*, specular, or mirror-like, reflections within the flat faceplate are converted in substantial part to diffuse reflections which do not appear as spurious images on the faceplate to a viewer. The manner in which the anti-glare aft surface 12*a* of the flat faceplate 12 is roughened in accordance with the present invention is described in detail below.

Figure 2:
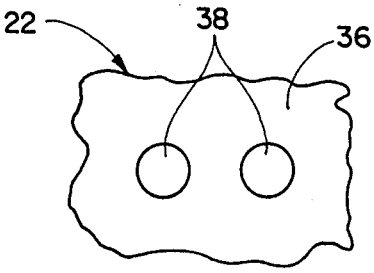
FIG. 2 shows a portion of the inner surface of a flat faceplate including a pair of phosphor dots.

Referring to FIG. 2, there is shown a plan view of the phosphor screen 22 disposed on the aft surface of the flat glass faceplate. As described above, the phosphor screen 22 includes a plurality of phosphor dots, two of which are shown as elements 38 in FIG. 2. The phosphor screen 22 further includes a black surround graphite layer 36 disposed around each of the phosphor dots 38. The phosphor dot array is arranged in a large number of dot trios, wherein each dot in a trio is illuminated by a respective one of the three electron beams in generating one of the primary colors of red, green and blue. The phosphor screen 22 is typically formed by first placing a layer of photoresist material such as bichromated polyvinyl alcohol (PVA) on the aft surface of the flat glass faceplate 12 and, with the foil tensioned shadow mask 30 positioned adjacent to and aligned with the faceplate, illuminating the aft surface of the faceplate through the shadow mask with a point source of light so as to produce a series of dots conforming to the array of apertures in the shadow mask. The thus illuminated dots in the phosphor screen 22 are water insoluble and the aft surface of the flat faceplate is washed with water so as to wash off all portions of the photoresist except the aforementioned illuminated dots thereof. Next, a coating of graphite with an appropriate binder, such as Aquadag, is positioned on the aft surface of the flat faceplate over the photoresist dots. The graphite layer is then exposed to a hydrogen peroxide solution which percolates through the graphite and dissolves away the photoresist dots in the process. After washing away the dots, the aft surface of the flat faceplate is then covered by the black graphite layer having a plurality of apertures therein which are arrayed in accordance with the apertures in the foil tensioned shadow mask 30. A phosphor coating is then positioned over the black graphite layer on the aft surface of the flat faceplate to provide the phosphor dots which, when struck by energetic electrons, produce a video image visible through the flat glass faceplate 12.

As shown in FIG. 2, the two phosphor dots 38 are circular and of equal size. This occurs when the aft surface of the flat faceplate is substantially flat and has a substantially uniform smoothness. On the other hand, where the faceplate is not flat and a black graphite layer of substantially uniform thickness is disposed on its aft surface, phosphor dots of varying size will form on the faceplate as shown for phosphor dots 40 and 42 in FIG. 3. The larger phosphor dot 42 will occur at an upraised portion of the rear surface of the flat faceplate because of the reduced thickness of the layer of PVA photoresist material used in forming the phosphor dots. On the other hand, the smaller phosphor dot 40 is a result of a depression on the aft surface of the faceplate due to the increased thickness of the layer of PVA photoresist material used in forming the phosphor dots.

Figure 3:
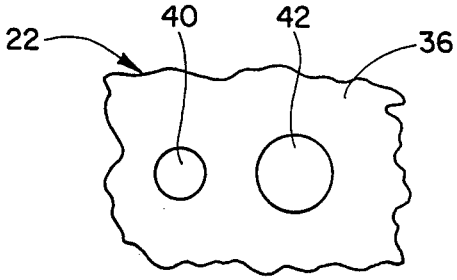
FIG. 3 also shows a portion of the inner surface of a faceplate whereon are positioned a pair of phosphor dots, with the two phosphor dots illustrated therein having different sizes.
Figure 4:
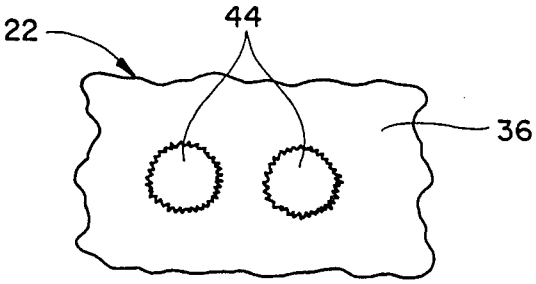
FIG. 4 illustrates a portion of the inner surface of a flat faceplate containing a pair of phosphor dots, wherein each phosphor dot has an irregular shape.

FIGS. 2 and 3 address the degree of flatness of the faceplate's aft surface, while FIG. 4 illustrates the effects of variation in the smoothness of this surface. Where the aft surface of the flat faceplate is characterized by a nonuniform, irregular surface having a low degree of smoothness, the phosphor dots will not be generally circular in shape and will be defined by highly irregular edge portions of the black graphite layer 36 as shown for phosphor dots 44 in FIG. 4.

Phosphor dots of varying size due to a lack of flatness of the faceplate or having irregular, nonuniform shapes due to nonuniformity in the smoothness of the faceplate cause degradation of the video image seen by a viewer through the flat faceplate. For example, phosphor dots of irregular, noncircular shape as shown in FIG. 4 will cause the intensity of each of the three primary colors to vary over the faceplate. In addition, the images of the three primary colors will tend to run together in an overlapping manner resulting in reduced color purity. Irregular phosphor dot sizes as shown in FIG. 3 will not only cause the aforementioned undesirable effects, but will also result in reduced light output due to smaller phosphor dot size.

Figure 5:
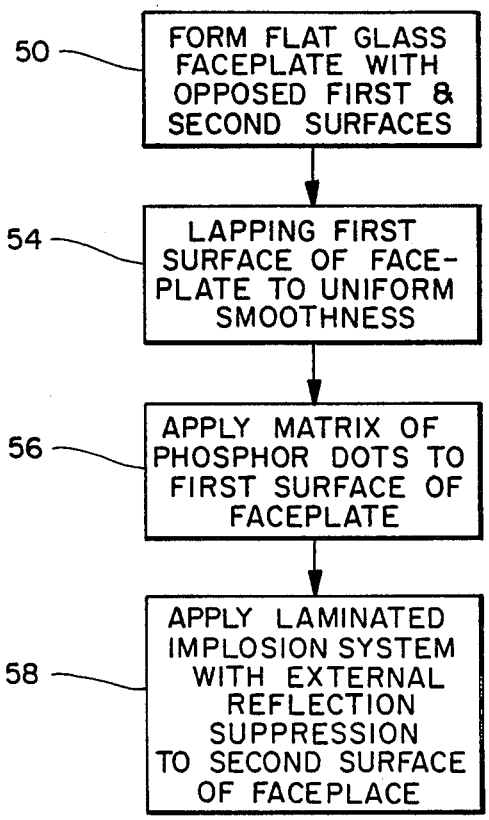
FIG. 5 is a simplified flow chart illustrating a method of producing a flat glass faceplate for a CRT with suppressed reflection in accordance with the present invention.

Referring to FIG. 5, there is shown a method of forming a glass faceplate for use in a CRT which provides the faceplate with a high degree of flatness and uniform smoothness in suppressing internal specular reflections therein, while eliminating several processing steps used in the prior art. The method for producing a flat glass faceplate of the present invention thus simplifies its manufacture and reduces its cost while preserving the faceplate's capability to accurately transmit a video image having a high degree of acuity.

The first step in fabricating a flat faceplate in accordance with the present invention is at step 50 wherein a flat glass faceplate with opposed first and second surfaces is formed. A flat faceplate, characterized by an undefined roughness, may be formed by any number of processes such as by drawing a large glass sheet from a tank of molten glass and cutting the glass sheet into appropriately sized rectangular glass panels, by utilizing float glass, or by pressing a formed, flat panel of glass. The inner, or aft, surface of the flat faceplate is then ground or lapped to produce a predetermined roughness and a high degree of flatness at step 54 using a free abrasive lapping machine, e.g., as manufactured by Speedfam Corporation, Des Plaines, Illinois. A matrix of phosphor dots is then formed on the first surface of the flat faceplate as previously described at step 56. Finally, a laminated implosion system with external reflection suppression as previously described with respect to FIG. 1 is applied to the second, or outer, surface of the flat faceplate at step 58. The faceplate assembly thus produced not only provides a high degree of internal reflection suppression, but also substantially eliminates external reflections from the outer surface of the faceplate in an implosion proof color CRT.

Figure 6A:
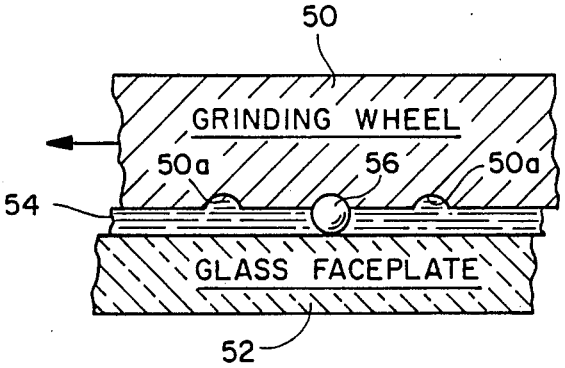
Fig. 6a (PRIOR ART)
FIGS. 6*a* and 6*b* provide an illustrative comparison between prior art working of a CRT faceplate to a desired surface roughness and the manner in which a CRT faceplate is lapped to a desired surface roughness in accordance with the present invention.
Figure 6B:
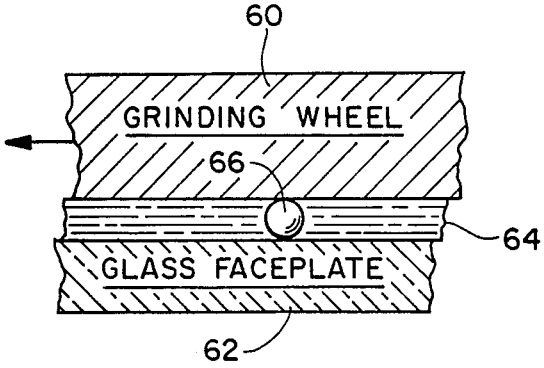

Referring to FIGS. 6*a* and 6*b*, there is shown an illustrative comparison between the working of a CRT faceplate to a desired surface roughness as carried out in the prior art and the manner in which a CRT faceplate is lapped to a desired surface roughness in accordance with the principles of the present invention. Referring specifically to FIG. 6*a*, there is shown a grinding wheel 50 which is a standard component in free abrasive lapping machines used to impart a given surface texture or roughness to the glass faceplate 52. In a conventional grinding process, a grit solution which includes a plurality of small particles 56 is disposed between the grinding wheel 50 and the glass faceplate 52 and is maintained in position and in suspension therebetween by means of a liquid carrier solution 54 which in some cases may be water. The grit particles 56 are typically comprised of aluminum oxide and have an average diameter of approximately 9–12 micro-inches depending on the size of the lapping machine. The grinding wheel 50 is displaced in the direction of the arrow in the figure relative to the glass faceplate 52. The grinding wheel 50 used in prior art glass faceplate lapping operations is typically comprised of a soft cast iron. With a force on the order of 1–2 pounds/square inch but perhaps as much as 4 pounds/square inch exerted upon the grinding wheel 50 in a direction toward the glass faceplate 52, the grit particles 56 tend to form indentations or notches 50*a* in the facing surface of the grinding wheel since the glass faceplate is harder than the cast iron grinding wheel. As the grinding wheel 50 is rotationally displaced in the direction of the arrow in FIG. 6*a*, the indentations 50*a* in the lower surface of the grinding wheel tend to engage the grit particles 56 and to drag the grit particles along the surface of the glass faceplate. With the grit particles 56 thus engaged and displaced in a scraping manner along the surface of the glass faceplate 52 by the grinding wheel 50, many of the grit particles are displaced in a continuous circular path on the upper surface of the glass faceplate. With the grit particles 56 thus displaced in a continuous path along and in tight-fitting engagement with the glass faceplate 52, the larger grit particles form scratches in the glass faceplate which degrade the acuity of a video image transmitted through the glass faceplate, and generally cut deep into the glass surface.

Referring to FIG. 6*b*, there is provided an illustration of the lapping of a glass faceplate 62 by means of a grinding wheel 60 in accordance with the principles of the present invention. In the present invention, the grinding wheel 60 is comprised of a hard metal such as steel rather than a soft, pliable metal as used in the prior art. With a plurality of grit particles 66 suspended in a liquid carrier solution 64 and disposed between the grinding wheel 60 and the glass faceplate 62 in a pressed manner, the hard surface of the grinding wheel 60 prevents the formation of indentations or notches therein as illustrated in FIG. 6*b*. With the lower surface of the grinding wheel 60 remaining substantially flat and free of irregularities, the grit particles 66 are displaceable in a rolling manner relative to the grinding wheel and are not displaced in a fixed orientation with respect to the grinding wheel. The grit particles 66 are thus free to move in a rolling manner between the grinding wheel 60 and the glass faceplate 62. With the grit particles 66 free to roll over the facing surfaces of the grinding wheel 60 and the glass faceplate 62, the formation of scratches and other irregularities in the surface of the glass faceplate by the grit particles is substantially reduced and essentially eliminated, and the depth of grinding is much reduced. Rolling displacement between the grit particles and the facing surfaces of the grinding wheel and the glass faceplate is ensured by selecting a grinding wheel material having a hardness which approximates the hardness of the glass faceplate. In fact, rubbing two glass faceplates together with an appropriate grit particle slurry disposed therebetween will impart the desired degree of roughness to the two opposed surfaces of the glass faceplates. The absence of scratches and other irregularities on the inner surface of the glass faceplate 62 ensures that video images transmitted therethrough exhibit a high degree of acuity, and may be viewed without inner reflections due to the rough surface texture imparted to the faceplate's inner surface.

There has thus been shown an improved flat glass faceplate, and method of fabrication therefor, which is particularly adapted for use in color CRTs and which is more simply and cheaply produced than prior art flat faceplates. By subjecting the inner surface of the flat faceplate to a lapping, or grinding, process using a free abrasive lapping machine, the surface of the faceplate may be provided with a highly uniform smoothness characterized by a well-defined roughness range of 6–9 micro-inches root mean square (RMS) depression value range for optimum video image acuity and minimum internal specular reflection.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A low cost CRT faceplate with suppressed reflections from its screen-bearing rear surface, comprising:

a flat glass faceplate having a rear surface roughened by a single lapping operation using loose grains on a hard, rigid grinding wheel in roughening said rear surface to a roughness on the order of 6–9 micro-inches root means square (RMS) depression value range such that it is ineffective to produce specularly reflected images and reflects light incident therein diffusely while being capable of accurately transmitting a video image therethrough; and a phosphor screen disposed on said roughened rear surface of said flat glass faceplate, whereby light images formed in said screen by electron bombardment and viewed through said screen, being substantially in the plane of said roughened rear surface, are not impaired, but images of objects in the surroundings are reflected diffusely and are not visible through said flat glass faceplate.

2. The CRT faceplate of claim 1 further comprising an implosion protection system disposed on a forward opposed surface of said flat glass faceplate.

3. The CRT faceplate of claim 2 wherein said implosion protection system includes a transparent implosion panel affixed to the forward surface of said flat glass faceplate.

4. The CRT faceplate of claim 3 further comprising an anti-glare coating disposed on an outer surface of said transparent implosion panel.

5. The CRT faceplate of claim 4 further comprising a resin layer disposed between and bonded to said transparent implosion panel and said flat glass faceplate, wherein said resin layer, said transparent implosion panel and said flat glass faceplate have respective indeces of refraction which are substantially equal.

6. The CRT faceplate of claim 1 further comprising a flat tensioned shadow mask attached to the roughened rear surface thereof.

7. A low cost cathode ray tube faceplate with suppressed reflections from its front surface and screen-bearing rear surface, comprising:

a flat glass faceplate having a rear surface roughened in a single grinding operation using loose grains on a hard, rigid grinding wheel in roughening said rear surface to a roughness on the order of 6–9 micro-inches root mean square (RMS) depression value range such that it is ineffective to produce specularly reflected images;

a phosphor screen on said roughened rear surface, whereby light images formed in said screen by electron bombardment, being substantially in the plane of said roughened rear surface are not impaired, but images of objects ian the surroundings are not formed by said rear surface due to its light scattering property; and a laminated implosion system on said front surface of said faceplate including a flat transparent glass implosion panel with an index of refraction approximating that of said faceplate, and a transparent cement bonding said panel to the front surface of said faceplate, said cement having an index of refraction substantially matching that of said faceplate to reduce or completely eliminate specular reflections from said front surface of said faceplate, said faceplate being characterized by said roughened state of said rear surface comprising a partial polish of said rear surface terminated while said surface is rough and before it is of such smoothness as to be capable of producing specularly reflected images.

8. A low cost CRT faceplate with suppressed reflections from its screen-bearing rear surface, comprising:

a flat glass faceplate with a rear surface roughened to a roughness range on the order of 6 to 9 micro-inches root mean square (RMS) depression value range in a single lapping operation using loose grains on a hard, rigid grinding wheel; and a phosphor screen disposed on said roughened rear surface of said flat glass faceplate, whereby light images formed in said screen by electron bombardment and viewed through said screen, being substantially in the plane of said roughened rear surface, are not impaired, but images of objects in the surroundings are reflected diffusely and are not visible through said flat glass faceplate.

* * * * *